US006216802B1

(12) United States Patent
Sawyer

(10) Patent No.: US 6,216,802 B1
(45) Date of Patent: Apr. 17, 2001

(54) GRAVITY ORIENTED DIRECTIONAL DRILLING APPARATUS AND METHOD

(76) Inventor: Donald M. Sawyer, 38 La Costa Dr., Montgomery, TX (US) 77356

( * ) Notice: Subject to any disclaimer, the term of this patent is extended or adjusted under 35 U.S.C. 154(b) by 0 days.

(21) Appl. No.: 09/420,449

(22) Filed: Oct. 18, 1999

(51) Int. Cl.[7] ..... E21B 7/00
(52) U.S. Cl. ..... 175/73; 175/61
(58) Field of Search ..... 175/73, 74, 90, 175/45, 61, 50, 250, 101, 107; 166/117.7

(56) References Cited

U.S. PATENT DOCUMENTS

| | | |
|---|---|---|
| 2,142,859 | 1/1939 | McMahan . |
| 2,167,194 | 7/1939 | Anderson . |
| 3,586,116 | 6/1971 | Tiraspolsky et al. . |
| 4,667,751 | 5/1987 | Geczy et al. . |
| 4,880,067 | 11/1989 | Jelsma . |
| 5,009,273 | 4/1991 | Grabinski . |
| 5,113,953 | 5/1992 | Noble . |
| 5,139,094 | 8/1992 | Prevedel et al. . |
| 5,305,838 | 4/1994 | Pauc . |
| 5,311,953 | 5/1994 | Walker . |
| 5,452,772 | 9/1995 | Van Den Bergh . |
| 5,484,029 | 1/1996 | Eddison . |
| 5,529,133 | 6/1996 | Eddison . |
| 5,617,926 | 4/1997 | Eddison et al. . |

*Primary Examiner*—Robert E. Pezzuto
(74) *Attorney, Agent, or Firm*—Rosenthal & Osha L.L.P.

(57) ABSTRACT

An apparatus for orienting a drilling assembly. In one embodiment the apparatus include a first driveshaft coupled to the drilling assembly, a second driveshaft flexibly coupled at one end to the first driveshaft, and an orientation collar disposed outside the first and second driveshafts so that the first and second driveshafts are freely rotatable within the collar. The is collar substantially coaxial with the first driveshaft and is adapted to maintain a substantially fixed rotary position. The apparatus includes a sensor for measuring the substantially fixed rotary orientation of the collar and an adjuster for selecting a center of rotation of the second driveshaft with respect to the axis of the collar in response to measurements made by the sensor, whereby an axis of rotation of the second driveshaft is selectable by changing the center of rotation

27 Claims, 7 Drawing Sheets

GRAVITY ORIENTED DIRECTIONAL DRILLING APPARATUS AND METHOD

BACKGROUND OF THE INVENTION

1. Field of the Invention

This invention relates generally to the field of methods and apparatus for drilling a wellbore along a desired trajectory. More specifically, the invention relates to tools for controlling the direction of a wellbore while drilling by rotating a drill pipe from the earth's surface is in progress.

2. Description of the Related Art

Wellbores used for petroleum production are often drilled along trajectories other than vertically from the earth's surface in a process referred to as directional drilling. The main purpose of directional drilling is for the wellbore to penetrate earth formations at a subsurface location different from the surface location from which the wellbore is started.

Various tools are well known in the art for directionally drilling wellbores, including hydraulically powered motors which turn a drill bit by converting the flow of drilling fluid ("mud") into rotational energy, the mud flow otherwise being used to cool the drill bit and lift drill cuttings out of the wellbore. Typical motors designed for directional drilling purposes include a housing which is bent at a preselected angle. These are known in the art as "bent-housing" motors. The power generation section of such motors is coupled to an output shaft, which ultimately turns the bit, by a flexible coupling. When this type of motor is used to adjust the trajectory of the wellbore, the entire drilling assembly, which includes drill pipe, drill collars, the motor, stabilizers and the drill bit, is slowly rotated from the earth's surface by a rotary drilling rig or similar apparatus so that the bend of the motor housing is oriented in the direction towards which the wellbore trajectory is to be adjusted. As is well known in the art, after the desired trajectory adjustment to the wellbore is finished, the bent-housing motor must be removed from the drilling assembly. This requires a time-consuming "trip out of the hole", where the entire drilling assembly is removed from the wellbore and a different assembly, which may exclude the bent-housing motor, is inserted into the wellbore to continue drilling along the adjusted trajectory.

In other cases, a so-called "steerable" motor can be used both to adjust and to maintain the trajectory of the wellbore during drilling. The typical steerable motor has a bent housing as does the bent-housing motor, but the bend is much smaller in magnitude. Adjusting the trajectory of the wellbore is accomplished with a steerable motor by adjusting the orientation of the motor housing as is done for the bent-housing motor, but when the desired trajectory is achieved, the trajectory can be maintained by rotating the entire drilling assembly from the earth's surface. Rotating the housing of a steerable motor generally causes the existing trajectory of the wellbore to be maintained.

Limitations of mud motor-based directional drilling include limited life of the power-generation section of the typical motor, which includes a positive displacement rotor disposed inside an elastomeric-lined stator. An additional limitation is that orientation of the motor housing can often be difficult to maintain, because as the drill bit contacts the earth formations to drill them, a reactive torque is generated against the motor housing which changes the orientation. A particular limitation of directional drilling using steerable motors is that steerable motors tend to drill a "corkscrew" shaped hole where the motor housing is rotated to maintain trajectory of the wellbore.

A different type of steerable rotary tool for directional drilling is presented in U.S. Pat. Nos. 5,484,029 and 5,529,133 to Eddison and U.S. Pat. No. 5,617,926 to Eddison et. al, hereafter collectively referred to as Eddison. This steerable tool comprises an upper housing which connects to the drill pipe and a lower driveshaft which attaches to the drill bit. The housing and driveshaft are coupled so that rotary torque from the housing is transmitted to the shaft while allowing the rotational axis of the bit to pivot universally to a limited degree relative to the longitudinal axis of the housing. Enclosed inside the housing is an internal "eccentric weight" arranged to have relative rotation with respect to said housing. Due to the effects of gravity, the weight remains substantially stationary at the low side of the directional wellbore. The upper end of the driveshaft is coupled to the stationary weight through an eccentric bearing to maintain the bit axis pointed in only one direction as the bit is rotated. Additionally, Eddison discloses an intricate clutch system used to alter the orientation of the drill bit downhole and a measuring-while-drilling (MWD) tool for monitoring directional parameters with respect to the position of the weight.

SUMMARY OF THE INVENTION

The invention is an apparatus for orienting a drilling assembly. The apparatus includes a first driveshaft coupled to the drilling assembly, a second driveshaft flexibly coupled to the first driveshaft, and an orientation collar disposed outside the first and second driveshafts so that the first and second driveshafts can rotate freely inside the collar while the collar remains rotationally fixed. The collar is substantially coaxial with the first driveshaft. The apparatus includes an adjuster for selecting a center of rotation of the second driveshaft with respect to an axis of the collar so that an axis of rotation of the second driveshaft is selected by changing the position of the center of rotation.

In one embodiment, the adjuster includes screws to set the position of a bearing disposed on the outside of the second driveshaft to change the position of a center of rotation of one point on the second driveshaft. In another embodiment, the adjuster includes a sleeve having a bore non-parallel with the axis of the collar, and a rotation and translation mechanism to slide and rotate the sleeve with respect to the collar. The bearing supporting the lower driveshaft is supported in the bore, so that changing the position and rotary orientation of the sleeve changes the relative angle of the second driveshaft with respect to the center line of the collar.

The collar in one embodiment is oriented by earth's gravity because the collar has asymmetric mass about its center line. The collar in various embodiments includes devices to resist rotation of the collar including vanes, mud discharge jets and a sprag which contacts the wellbore wall.

In another embodiment, the orientation of the collar is measured, and the relative angle of rotation of the second driveshaft with respect to the center line of the collar is adjusted in response to the measured orientation. In this embodiment, the collar can include various devices to resist rotation thereof.

DETAILED DESCRIPTION

Figure 1:
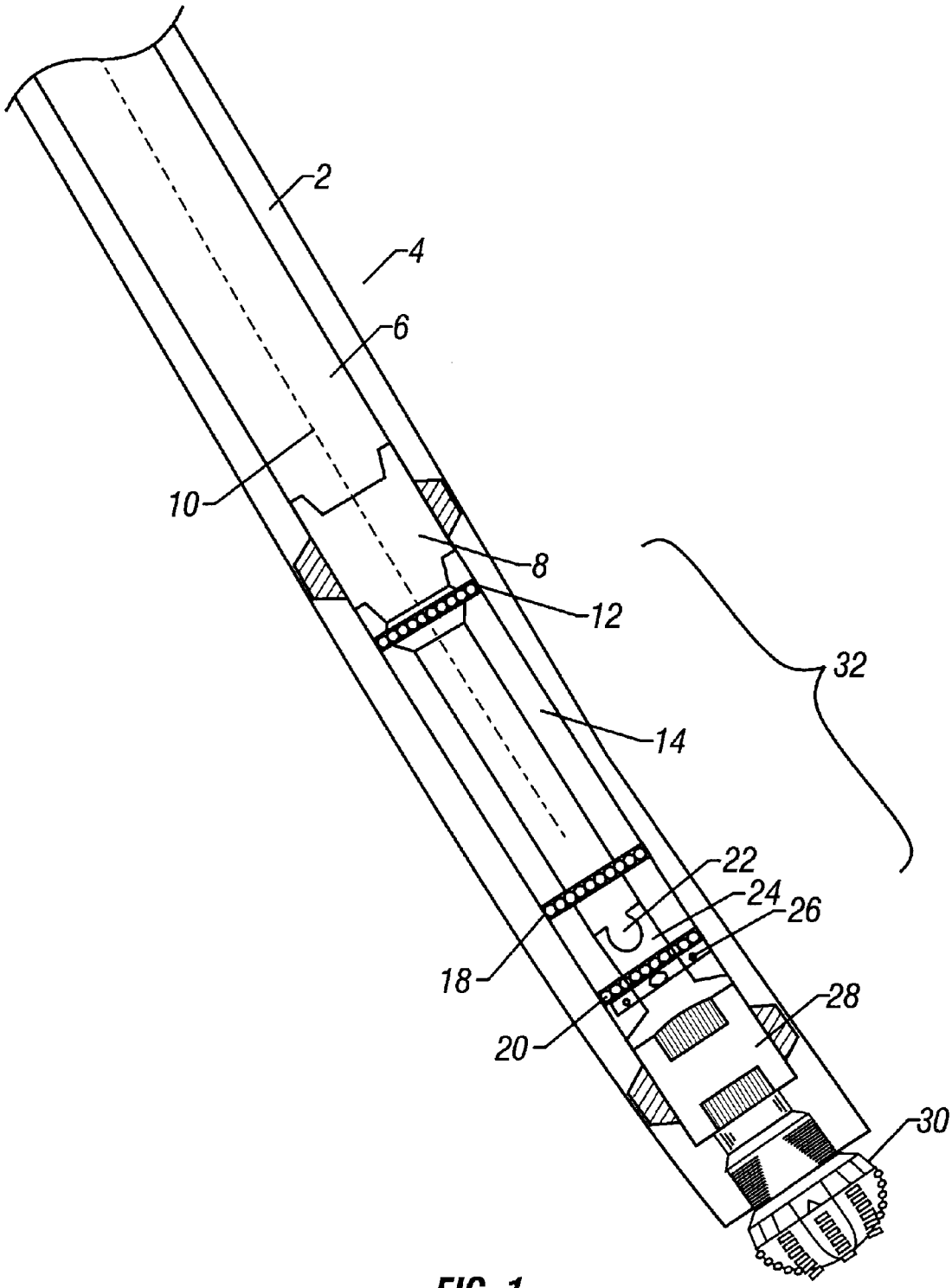
FIG. 1 shows one embodiment of the invention in cross-section as it is used to directionally drill a wellbore penetrating earth formations.

FIG. 1 shows one embodiment of the invention as it is to be used to directionally drill a wellbore through earth formations. The wellbore is shown generally at 2 as it has been drilled through the earth formations, shown generally at 4. The wellbore 2 can be drilled using a rotary drill bit 30 of any type well known in the art.

As is well known in the art, rotary power to turn the drill bit 30 can be provided by a drilling rig (not shown) or the like located on the earth's surface. The drilling rig (not shown) is typically coupled to the drill bit 30 by a drilling assembly which includes sections of threaded drill pipe, one section of which is shown at 6. As is also well known in the art, the drill pipe 6 can include, generally at the bottom end, larger diameter, high-density sections known as "heavy-weights" or "drill collars" which increase the bottom-end weight of the drilling assembly so that earth's gravity can assist in providing axial force to the drill bit 30. A drilling assembly which includes only drill pipe 6, collars, the bit 30, and centering tools known as stabilizers, shown generally at 8 and 28, will follow a trajectory affected by gravity, the flexibility of the drilling assembly and the mechanical properties of the earth formations 4 through which the well is drilled. The rotational axis (not shown) of the drill bit 30 in such drilling assemblies is substantially coaxial with the center line 10 of the drilling assembly, not taking account of any flexibility of the drilling assembly.

Directional drilling systems, such as described in the Background section herein, cause the rotational axis (not shown) of the drill bit 30 to be deflected from the center line (rotational axis) 10 of the drill pipe 6 in a selected direction. This embodiment of the invention, shown generally at 32 and for convenience referred to hereafter as a "steering system", provides an improved mechanism to place the axis of rotation of the drill bit 30 along such a selected direction.

The principal components of this embodiment of the steering system 32 include an orientation collar, shown at 16 in FIG. 1. The purpose of the orientation collar 16 is to provide a rotationally fixed reference against which to set an axis of rotation of the drill bit 30, as will be further explained. In this embodiment, the orientation collar 16 is an asymmetrically weighted collar ("AWC"), which includes means of bearings 12, 18 and 20 to enable free rotation within the orientation collar 16 of an upper driveshaft 14 and a lower driveshaft 24. As will be further explained, in this embodiment the orientation collar 16 is asymmetric in mass radially or circumferentially about its axis (that is, it is rotationally unbalanced) so that one side of the orientation collar 16 will tend to rest downwardly, that is, in the direction of gravity. The asymmetry of the mass of the orientation collar 16 in this embodiment provides one element of the steering system 32 which is substantially rotationally fixed during drilling. Components which are rotationally coupled to the collar 16, which will be further explained, will thus be oriented with respect to earth's gravity.

Rotary torque can be transmitted from the drilling rig (not shown) at the earth's surface directly to the bit 30 through the steering system 32. The upper driveshaft 14 is coupled at one end to the drill pipe 6, optionally through upper stabilizer 8. The upper driveshaft 14 can be flexibly coupled to the lower driveshaft 24 by means of a universal joint, flexible coupling, constant velocity joint or any similar flexible rotary connection, shown generally at 22, which enables transmission of rotary torque across a change in direction of the axis of rotation. The upper driveshaft 14 rotates substantially collinearly with the drill pipe 6 immediately connected thereto because it is held in position relative to the collar 16 by the upper bearing 12 and center bearing 18, both of which are positioned substantially collinearly with the collar 16. The lower driveshaft 24 can be coupled through lower stabilizer 28 to the bit 30, through a mud motor (not shown) or any other drilling tools. Selection of and location of stabilizers 8, 28 in the drilling assembly depends on the intended trajectory of the wellbore as is known in the art, and such placements of stabilizers and drilling tools are not intended to limit the invention.

In the invention, the orientation of the axis of rotation of the lower driveshaft 24 with respect to the center line 10 of the orientation collar 16 is generally changed by changing the position of the center of the lower bearing 20 with respect to the center line 10 of the orientation collar 16, as will be further explained. The orientation of the axis of rotation of the lower driveshaft 24 will thus be determined by the relative position of the lower bearing 20 with respect to the center line 10 of the orientation collar 16.

In one embodiment of the invention, the position of the lower bearing 20 can be changed by means of adjusting screws, shown generally at 26. The adjusting screws 26 are preferably located in the lower part of the orientation collar 16, whereby an outer case of the collar 16 serves as a fixture against which to adjust the position of the lower bearing 20. The means used to adjust the position of the lower bearing 20 with respect to the center of the collar 16 shown in FIG. 1 is only one example of possible adjustment means. The means actually used to adjust the position of the lower bearing 20 with respect to the center of the collar 16 is a matter of convenience for the system designer and is not meant to limit this aspect of the invention.

Figure 5A:
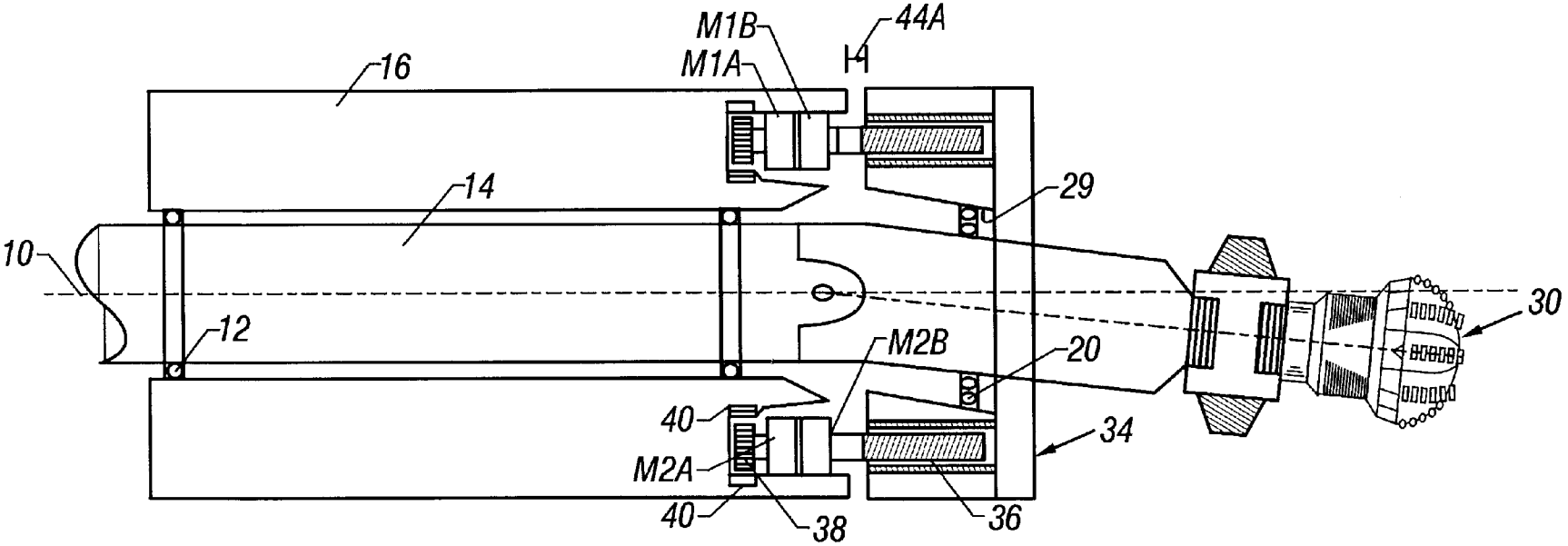
FIGS. 5A and 5B show an embodiment of a sleeve used to adjust the orientation of the drill bit with respect to asymmetrically weighted collar.
Figure 5B:
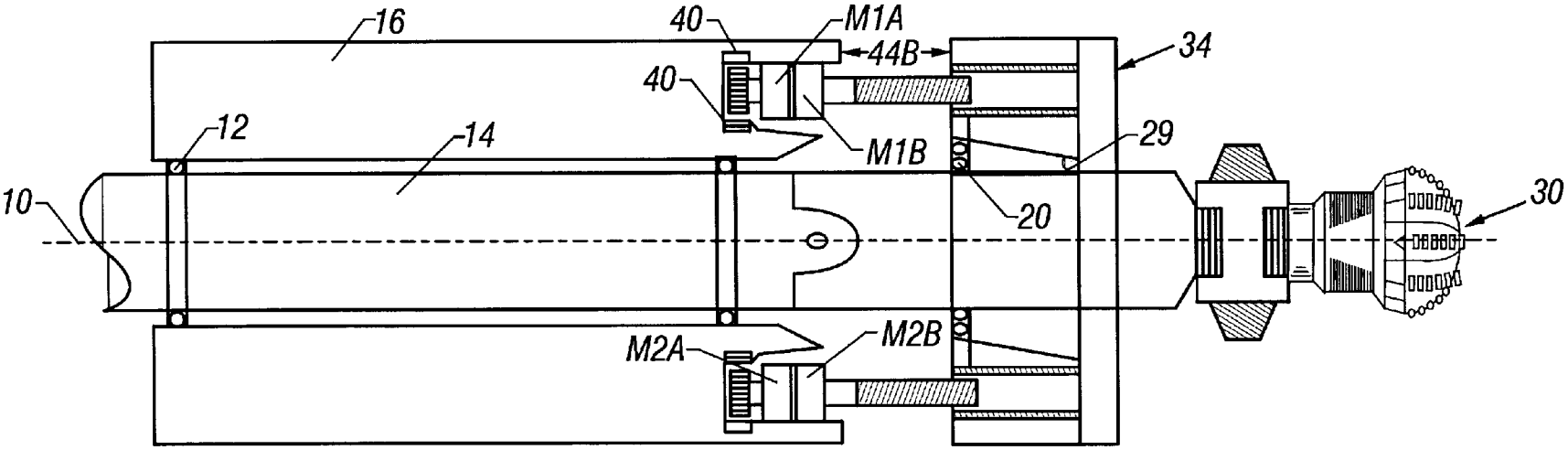

With respect to the example shown in FIG. 1, while the adjuster for setting the position of the lower bearing 20 is fixed, in another aspect of the invention, an adjuster which can be operated while the steering system 32 is in the wellbore 2 can also be used. For example, a sliding sleeve adjuster 34 having an internal bore 29 which is not parallel to the center line 10 of the orientation collar 16 can be used to adjust the center position of the lower bearing 20 with respect to the center line 10 of the collar 16, as shown in FIGS. 5A and 5B. Using the sliding sleeve 34 having such a non-parallel internal bore 29, the angular displacement of the bit 30 can be adjusted by axially displacing the sleeve 34 relative to the orientation collar 16 until the desired magnitude of the angle of lower shaft 24 with respect to the center line 10 of the orientation collar 16 is selected. This is illustrated in FIGS. 5A and 5B, wherein the sleeve 34 can be translated from a first position 44A (FIG. 5A), to a second position 44B (FIG. 5B), thereby adjusting the magnitude of the angle of the lower shaft 24 with respect to the center line 10 of the collar 16. Rotating the sleeve 34 relative to the collar 16 provides the desired azimuthal orientation of the bit 30 with respect to the orientation of the collar 16. Mechanisms for translating and rotating the sliding sleeve 34 with respect to the collar 16 are known in the art. One example of such a translation and rotation mechanism is shown in FIGS. 5A and 5B, wherein the sliding sleeve 34 uses worm gears 36 driven by motors M1B, M2B for translation, and spur gears 38 driven by motors M1A, M2A in meshing engagement with gear teeth 40 on the collar 16 for rotation. Alternatively, hydraulic actuation or other means may be used. The actual translation and rotation means used with the sliding sleeve 34 are a matter of convenience for the system designer and are not meant to limit this invention.

Additionally, the shape of the bore 29 of the sliding sleeve need not be a straight as shown in FIGS. 5A and 5B.

Alternatively an increasing-helix radius helical bore (not shown) can be used wherein the sleeve 34 may simply be axially displaced to adjust both the angle magnitude and azimuthal orientation of the lower shaft 24, and consequently the drill bit 30, with respect to the center line (10 in FIG. 1) of the collar 16.

Referring once again to FIG. 1, alternatively, an hydraulic cylinder type adjuster (not shown) could be disposed between the outer race of the lower bearing 20 and the collar 16 to adjust the center position of the lower bearing 20 with respect to the center line 10 of the collar 16.

The hydraulic cylinder-based adjuster, as well as the sleeve adjuster shown in FIGS. 5A and 5B can be configured, using control circuits well known in the art, to be responsive to measurements from a measurement-while-drilling (MWD) system (not shown) forming part of the drilling assembly, or to be responsive to drilling mud pressure-based command signals sent from the earth's surface. Such remotely operable adjusters make possible both wellbore trajectory adjustments during drilling, and trajectory maintenance settings where the center of rotation of the lower bearing 20 is set to be axially parallel with the center line 10 of the orientation collar 16, so that the extant trajectory of the wellbore 2 will be maintained.

Figure 2:
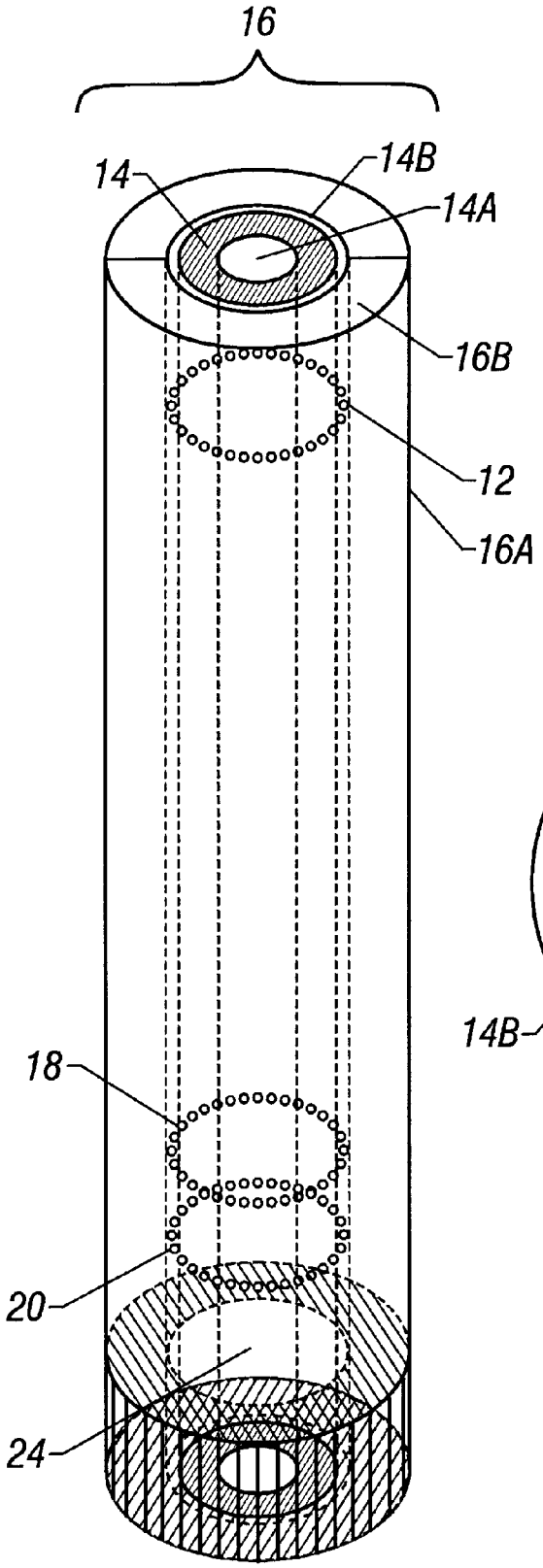
FIG. 2 shows one embodiment of an orientation collar for the invention, which is an asymmetrically weighted collar.
Figure 3:
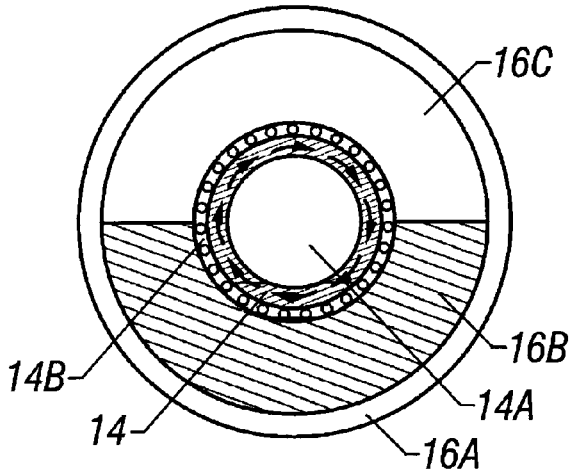
FIG. 3 shows the embodiment of FIG. 2 in cross-section.

The orientation collar 16 and components running through it are shown in more detail in FIGS. 2 and 3. In FIG. 2, the collar 16 can include the previously mentioned case 16A which in this embodiment can be a steel pipe or the like preferably being cylindrically shaped and having an outside diameter comparable to that of the drill pipe (6 in FIG. 1) connected to the upper driveshaft 14. For example, if the portion of the drill pipe (6 in FIG. 1) connected to the upper driveshaft is a 6.75 inch (171.45 mm) O. D. "heavy weight" or "drill collar", then the case 16A preferably has the same 6.75 inch (171.45 mm) outside diameter to maintain overall stability of the drilling assembly. It should be understood, however, that the shape of and the outside diameter of the case 16A is a matter of convenience for the system designer and is not meant to limit the invention. The upper driveshaft 14, as well as the lower driveshaft 24 preferably include a centrally located passage or bore 14A through which the drilling mud can flow.

The inner diameter of the case 16A, although its actual dimension is not critical to the invention, should preferably be selected to provide a space 14B for the bearings 12, 18, 20 between the inner diameter of the case 16A and the outer diameter of the driveshafts 14, 24. The inner diameter of the case 16A should also be as small as is practical, as should be the outside diameter of the driveshafts 14, 24, to enable the mass of the collar 16 to be as large, and as asymmetric about the axis of rotation as possible, consistent with the need for of adequate bending stiffness of the driveshafts 14, 24 and of the overall drilling assembly, and consistent with the driveshafts 14, 24 having the capacity to transmit adequate rotary torque to the bit (30 in FIG. 1) without breaking.

The case 16A in this embodiment includes therein a high specific gravity section, shown generally at 16B. The high specific gravity section 16B is shown as subtending about half the total circumference of the case 16A, but it should be understood that the amount of the circumference subtended by the high specific gravity section 16B is a matter of convenience for the system designer and is not meant to limit the invention. The actual shape of the high specific gravity section 16B is also a matter of convenience, and the generally cylindrical-section shape shown in FIG. 2 should not be construed as a limitation on the invention. A cross-section of the collar 16, including the case 16A, the high specific gravity section 16B and a corresponding low specific gravity section 16C, is shown in FIG. 3. The high specific gravity section 16B can be formed, for example, by filling the part of the case 16A with very dense materials such as lead, depleted uranium or the like. The low specific gravity section 16C may be merely enclosed air space, but preferably includes filling that portion of the case 16A with a low density, relatively incompressible material, such as oil or aluminum for example, so that the case 16A will resist crushing under hydrostatic pressure in the passage 14A and in the wellbore (4 in FIG. 1). The high specific gravity section 16B will tend to rest in the direction of gravity, providing a rotationally fixed reference against which to set the position of the lower bearing 20 with respect to the center of the collar 16. As previously explained, setting the position of the center of the lower bearing 20 at a known location from the center of the orientation collar 16 provides an axis of rotation for the lower driveshaft 24 which is different from the axis of rotation of the upper driveshaft 14 and which is oriented in a known, selected direction with respect to the known rotational reference, i. e. earth's gravity.

Figure 4A:
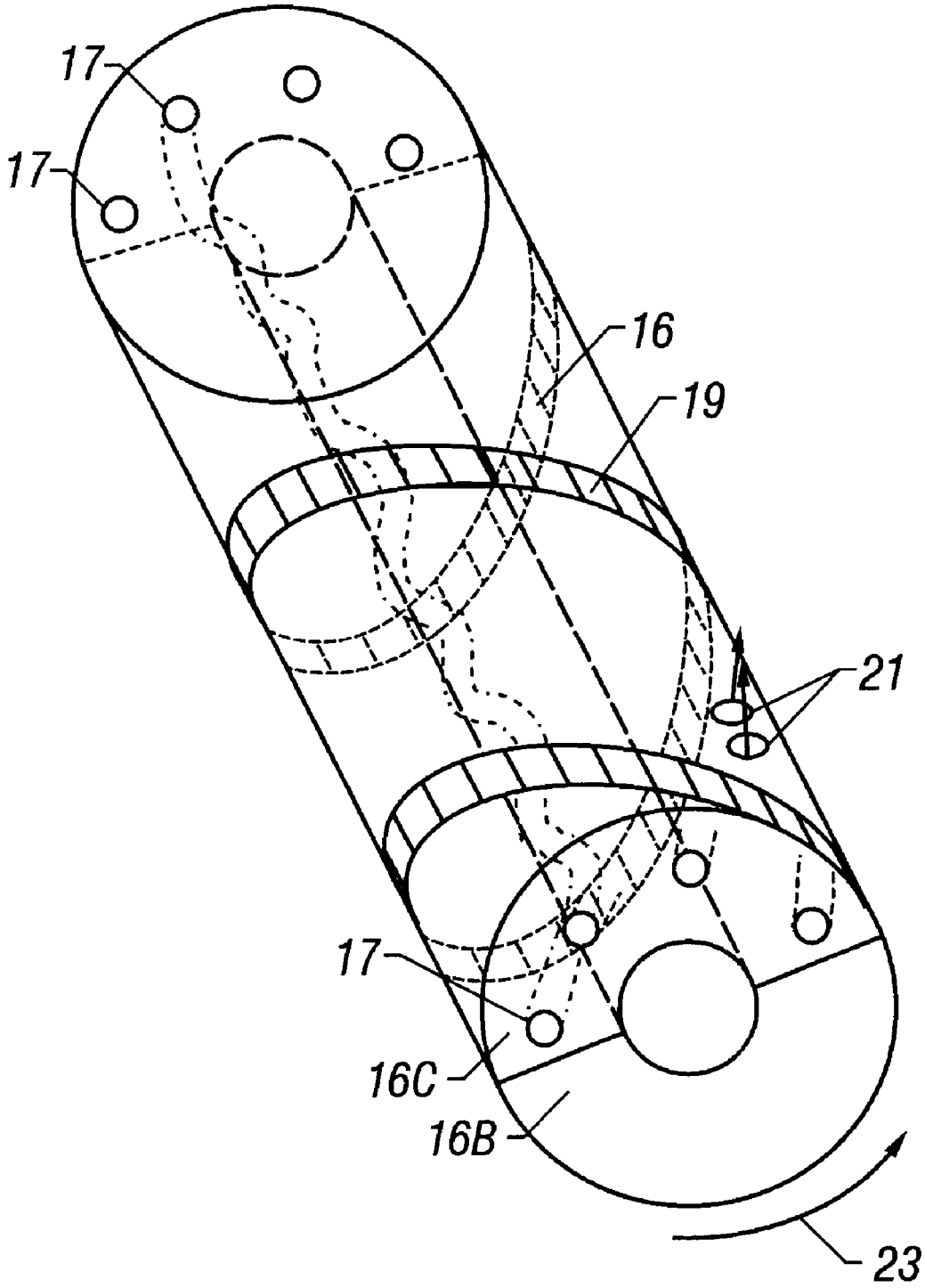
FIG. 4A shows embodiments of several improvements to the orientation collar of FIG. 2, which reduce the tendency of the asymmetrically weighted collar to rotate as a result of fluid friction between the collar and a driveshaft.

Additional features which can reduce the tendency of the orientation collar 16 to be rotated by fluid friction between the driveshafts (14, 24 in FIG. 1) and the collar 16 are shown in FIG. 4A. In one such improvement, the low specific gravity section 16C, where filled with a solid such as aluminum, for example, can include spiral passages 17 therethrough which can be hydraulically connected to the passage (14B in FIG. 2). Fluid inertia of the mud flowing in the spiral passages 17 can reduce the tendency of the orientation collar 16 to rotate away from its gravitational orientation.

Another such improvement can include helically spaced-apart vanes or fins 19 disposed on the exterior of the case 16A so that fluid flow up the annulus (2 in FIG. 1) will tend to stabilize the rotational position of the collar 16.

Still another improvement can include jets 21 formed through the collar 16 which interconnect the passage (14B in FIG. 2) and the annulus (4 in FIG. 1) and have a discharge direction such that drilling mud discharged through the jets 21 will create a thrust tending to oppose fluid-friction induced rotation of the collar 16 in the direction of rotation 23 of the drill pipe (6 in FIG. 1).

Figure 4B:
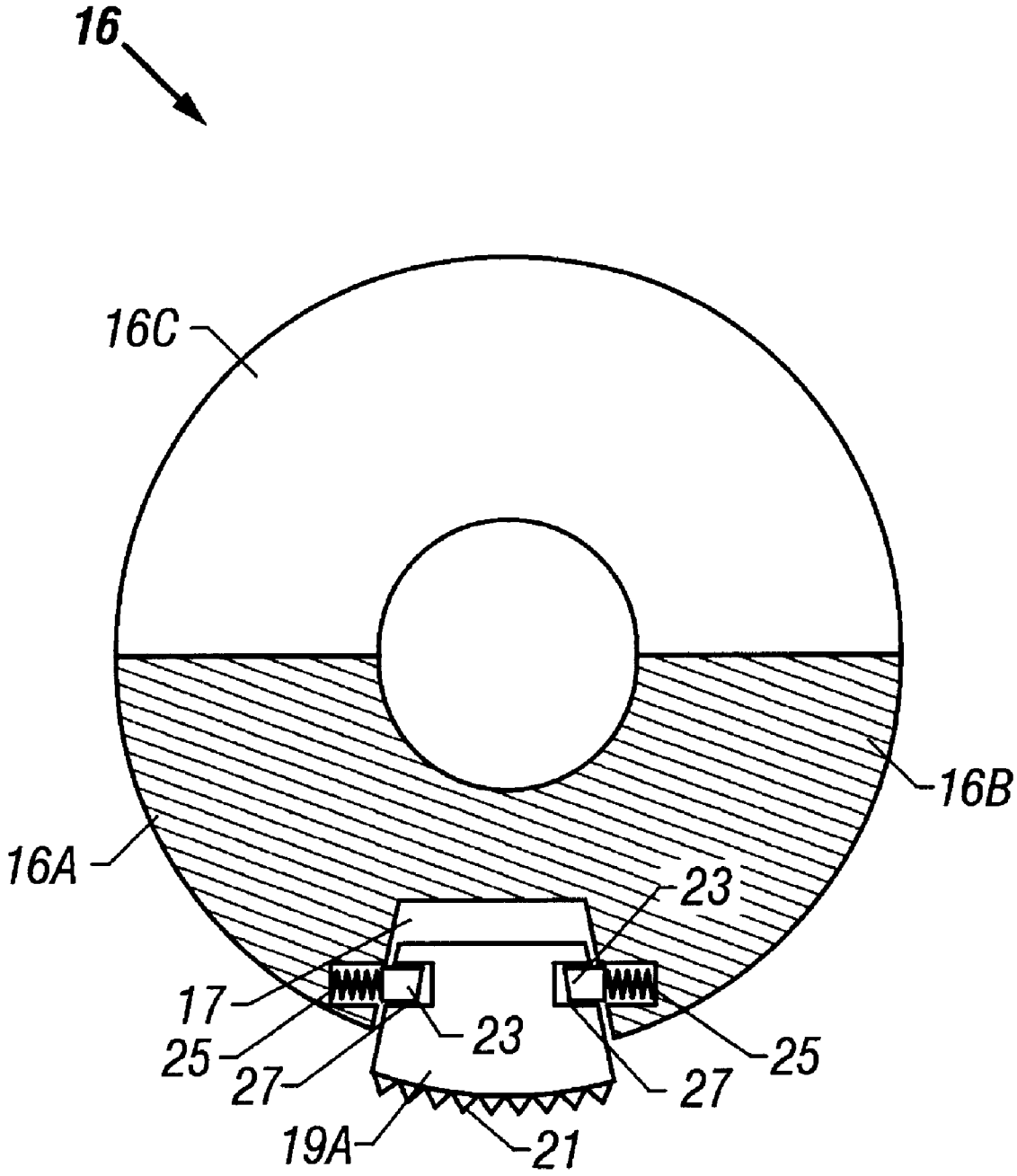
FIG. 4B shows another embodiment of an improvement used to reduce rotation of the collar.

Still another example of an improvement to the case 16A used to resist rotation of the case 16A while drilling is shown in FIG. 4B. The case 16A includes in the heavy weight section 16B a sprag 19 which can extend by gravity so that friction teeth 21 disposed on the outside of the sprag 19 can contact the wall of the wellbore. Lateral movement of the sprag 19 can be limited by pins 23 loaded by springs 25 to mesh in mating slots 27 in the sprag 19, the slots 27 being shaped to enable the sprag 19 to move laterally inward, but also to limit lateral outward movement of the sprag 19 from the case 16A. The sprag 19 shown in this example is actuated by gravity, but it should be clear to those skilled in the art that powered forms of actuation for the sprag, such as hydraulic cylinders, solenoids, springs or the like can also be used to extend the sprag 19 laterally from the case 16A.

Figure 6:
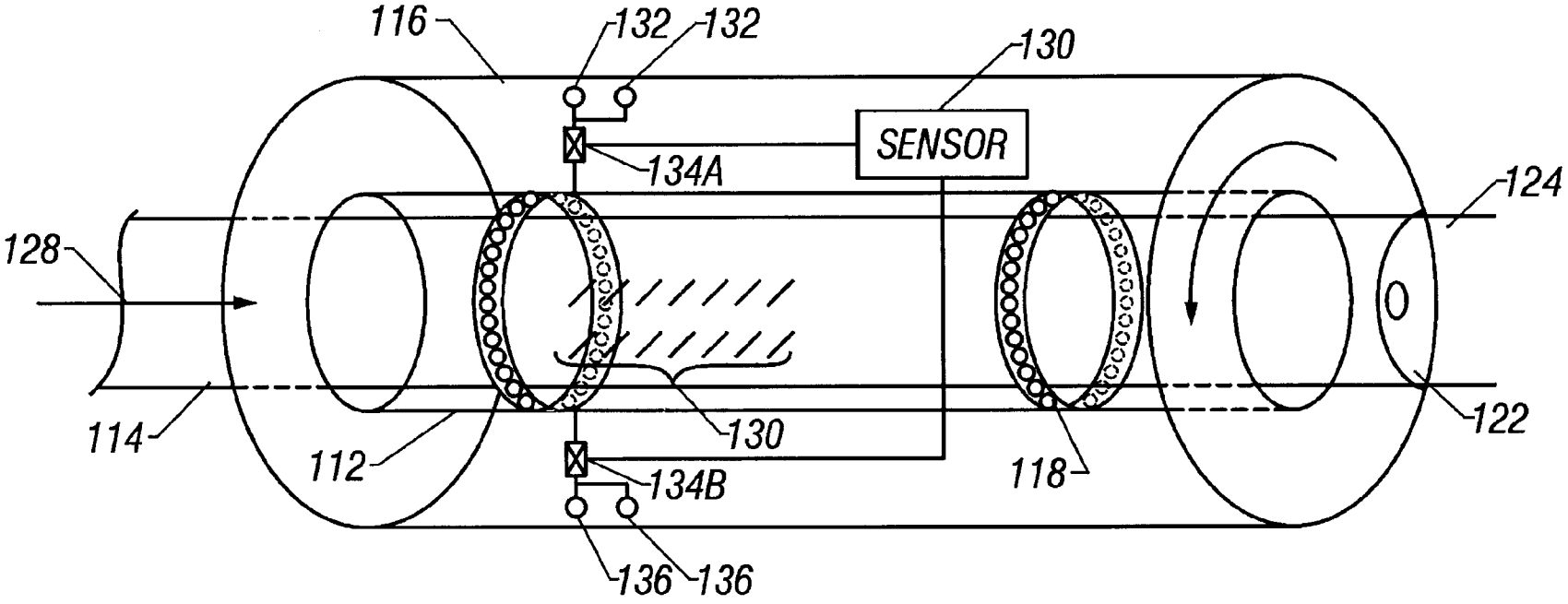
FIG. 6 shows an alternative embodiment of the collar.

The preceding embodiments of the orientation collar 16 rely on earth's gravity to orient the collar 16. As previously explained, the orientation of the collar 16 is used as a fixed reference against which to set the position of the bearing supporting the lower driveshaft (20 in FIG. 1). By setting the position of the lower bearing 20 with respect to the collar 16, the magnitude and direction of the angle of the second driveshaft can be set with respect to the center line of the collar 16. In the present embodiment of the collar 16, the collar 16 need not include asymmetric mass but can have its relative orientation determined by means other than earth's gravity. Referring now to FIG. 6, the present embodiment of the orientation collar will be explained. The orientation collar in this embodiment is shown generally at 116 and is formed generally in the shape of a cylinder. A first driveshaft 114, which is similar to the first driveshaft in the other embodiments of the invention, rotates inside the collar 116 on bearings 112, 118. The first driveshaft, as previously explained, is rotated by a drilling rig, mud motor or similar rotary power source. The orientation collar 116 in this embodiment can be symmetric in mass distribution, to enable the collar 116 to be freely rotated irrespective of its orientation with respect to gravity. As in the previous embodiments of the invention, the first driveshaft 114 is flexibly coupled to a second driveshaft 124 through a flexible coupling. The second driveshaft 124 can be supported by a lower bearing (not shown in FIG. 6) disposed in an adjuster mechanism (not shown in FIG. 6) similar to those described in the previous embodiments (such as 20 in FIG. 1). In the present embodiment, the adjuster mechanism (not shown) works in substantially the same manner as in the previous embodiments shown in FIGS. 5A and 5B, and for clarity of the description will not be repeated here.

In the present embodiment, the first driveshaft 114 can include therein slots or perforations 130 which enable passage of pressurized drilling mud 128 pumped from the surface to flow out of the first driveshaft 114 and pressurize the annular space between the collar 116 and the first driveshaft 114, axially between bearings 112 and 118. The pressurized mud is selectively vented to an annular space between the collar 116 and a wellbore (not shown) through discharge jets 132 and 136. When the pressurized mud is discharged through jets 132, the collar 116 will tend to rotate in the direction opposite to the mud flow therethrough. Jets 136 are positioned to cause the opposite rotation of the collar 116 when mud is vented therethrough. By selective venting of the pressurized mud through the jets 132, 136, the collar 116 can be rotated to to a selected rotary orientation, and the selected rotary orientation can be maintained.

The control of pressurized mud venting through the jets 132, 136 can be performed by selectively operable valves 134A, 134B, respectively. The valves 134A, 134B operate in response to a directional sensor 130. The directional sensor 130 can be a magnetometer, accelerometers, gyroscope or any other device which makes measurements corresponding to the orientation of the sensor with respect to a fixed reference, such as magnetic north, geographic north or earth's gravity, for example. The output of the sensor 130 is used to selectively operate the valves 134A, 134B to maintain the selected rotary orientation of the collar 116. Other types of mechanisms for rotating the collar 116 to maintain rotary orientation can be used in place of the jets 132, 136, for example tractor pads or the like.

Still other embodiments of the orientation collar need not include the jets 132, 136 shown in FIG. 6 or other device to select the orientation of the collar 116. Instead, the collar 116 may include the anti-rotation devices shown in FIGS. 4A and 4B to maintain the collar 116 in a rotationally fixed position. Where jets or other devices to select a rotary orientation are not used, it is preferable to include a sensor, such as 130 in FIG. 6, to measure the extant orientation of the collar 116. The orientation and angle magnitude applied to the lower driveshaft 124 by the adjuster (such as 34 in FIGS. 5A and 5B) can be set in response to the measured orientation of the collar 116, to provide a selected change in direction of drilling the wellbore. Note that in this embodiment, it is not necessary to set the orientation of the collar, it is only necessary to determine the orientation and to set the orientation and angle magnitude of the adjuster (such as 34 in FIG. 5A) in response to the determined orientation.

It will be apparent to those skilled in the art that the foregoing description is only intended to illustrate examples of the invention, and that those skilled in the art will be able to devise other embodiments of the invention which do not depart from the spirit of the invention as disclosed in the embodiments described herein. Accordingly, the scope of the invention shall be limited only by the attached claims.

What is claimed is:

1. An apparatus for orienting a drilling assembly, comprising:

a first driveshaft rotationally coupled to said drilling assembly;

a second driveshaft flexibly coupled at one end to said first driveshaft;

a radially asymmetric mass disposed outside said first and said second driveshafts so that said first and second driveshafts are freely rotatable within said mass, said mass substantially coaxial with said first driveshaft; and an adjuster for selecting a center of rotation of said second driveshaft with respect to the axis of said mass whereby an axis of rotation of said second driveshaft is selectively adjusted by changing said center of rotation.

2. The apparatus as defined in claim 1 wherein said mass comprises an asymmetrically weighted collar having substantially cylindrical shape.

3. The apparatus as defined in claim 1 wherein said mass further comprises a high specific gravity section and a low specific gravity section.

4. The apparatus as defined in claim 3 wherein said high specific gravity section comprises lead.

5. The apparatus as defined in claim 3 wherein said high specific gravity section comprises depleted uranium.

6. The apparatus as defined in claim 3 wherein said low specific gravity section comprises aluminum.

7. The apparatus as defined in claim 3 wherein said low specific gravity section comprises spiral passages therethrough to resist rotation of said eccentric mass.

8. The apparatus as defined in claim 3 wherein said low specific gravity section comprises oil filling a space between an outer case of said mass and an inside surface of said mass.

9. The apparatus as defined in claim 1 wherein said mass further comprises at least one fin disposed on an exterior surface thereof to reduce rotation of said mass from fluid flow external to said mass.

10. The apparatus as defined in claim 1 wherein said mass further comprises at least one jet having a discharge direction opposed to a direction of rotation of said drilling assembly whereby rotation of said mass is reduced by fluid discharge from said at least one jet.

11. The apparatus as defined in claim 1 wherein said mass comprises a sprag disposed in said mass, said sprag extending laterally from said mass to resist rotation of said mass.

12. The apparatus as defined in claim 1 wherein said adjuster comprises screws disposed between an outside of a bearing supporting said second driveshaft and an inside surface of said mass.

13. The apparatus as defined in claim 1 wherein said adjuster comprises at least one hydraulic cylinder disposed between an outer race of a bearing supporting said second driveshaft and an inside surface of said mass.

14. The apparatus as defined in claim 1 wherein said adjuster comprises a sleeve having an internal bore non-parallel with said axis of said mass, a bearing fixed onto said second driveshaft and supported within said non-parallel bore, a translation mechanism for translating said sleeve with respect to said mass and a rotation mechanism for rotating said sleeve with respect to said mass so that a center of said bearing is adjustable with respect to said axis of said mass by selective rotation and translation of said sleeve with respect to said mass, thereby enabling adjustment of said axis of rotation of said second driveshaft with respect to said axis of said mass.

15. The apparatus as defined in claim 1 wherein said adjuster comprises a sleeve having an helical internal bore, a bearing fixed onto said second driveshaft and supported within said helical bore, a translation mechanism for translating said sleeve with respect to said mass so that a center of said bearing is adjustable with respect to said axis of said mass by selective translation of said sleeve with respect to said mass thereby enabling adjustment of said axis of rotation of said second driveshaft with respect to said axis of said mass.

16. An apparatus for orienting a drilling assembly, comprising:

a first driveshaft rotationally coupled to said drilling assembly;

a second driveshaft flexibly coupled at one end to said first driveshaft;

a radially asymmetric mass disposed outside said first driveshaft so that said first driveshaft is freely rotatable within said mass, said mass substantially coaxial with said first driveshaft; and a sleeve disposed outside said second driveshaft, said sleeve having an internal bore non-parallel with an axis of said mass, a bearing fixed onto said second driveshaft and supported within said non-parallel bore, a translation mechanism for translating said sleeve with respect to said mass and a rotation mechanism for rotating said sleeve with respect to said mass so that a center of said bearing is adjustable with respect to said axis of said mass by selective rotation and translation of said sleeve with respect to said mass thereby enabling adjustment of said axis of rotation of said second driveshaft with respect to said axis of said mass.

17. An apparatus for orienting a drilling assembly, comprising:

a first driveshaft rotationally coupled to said drilling assembly;

a second driveshaft flexibly coupled at one end to said first driveshaft;

a radially asymmetric mass disposed outside said first driveshaft so that said first driveshaft is freely rotatable within said mass, said mass substantially coaxial with said first driveshaft; and a sleeve disposed outside said second driveshaft, said sleeve having an helical internal bore, a bearing fixed onto said second driveshaft and supported within said helical bore, a translation mechanism for translation of said sleeve with respect to said mass so that a center of said bearing is adjustable with respect to an axis of said mass by selective translation of said sleeve with respect to said mass thereby enabling adjustment of said axis of rotation of said second driveshaft with respect to said axis of said mass.

18. An apparatus for orienting a drilling assembly, comprising:

a first driveshaft rotationally coupled to said drilling assembly;

a second driveshaft flexibly coupled at one end to said first driveshaft;

an orientation collar disposed outside said first and second driveshafts so that said first and second driveshafts are freely rotatable within said collar, said collar substantially coaxial with said first driveshaft and adapted to maintain a substantially fixed rotary position;

a sensor for measuring said fixed rotary orientation of said collar and an adjuster for selecting a center of rotation of said second driveshaft with respect to the axis of said collar in response to measurements made by said sensor whereby an axis of rotation of said second driveshaft is selectable by changing said center of rotation.

19. The apparatus as defined in claim 18 wherein said adjuster comprises:

a sleeve disposed outside said second driveshaft, said sleeve having an internal bore non-parallel with an axis of said collar, a bearing fixed onto said second driveshaft and supported within said non-parallel bore, a translation mechanism for translating said sleeve with respect to said collar and a rotation mechanism for rotating said sleeve with respect to said collar so that a center of said bearing is adjustable with respect to said axis of said collar by selective rotation and translation of said sleeve with respect to said collar thereby enabling adjustment of said axis of rotation of said second driveshaft with respect to said axis of said collar.

20. The apparatus as defined in claim 18 wherein said fixed rotary orientation is selectable by selectively operable mud jets, said mud jets forming controllable hydraulic passages between a high pressure mud passage and an annulus between said collar and a wellbore.

21. The apparatus as defined in claim 18 wherein said sensor generates a measurement with respect to magnetic north.

22. The apparatus as defined in claim 18 wherein said sensor generates a measurement with respect to earth's gravity.

23. The apparatus as defined in claim 18 wherein said sensor generates a measurement with respect to geographic north.

24. The apparatus as defined in claim 18 wherein said collar comprises asymmetrically distributed mass therein so as to maintain said substantially fixed rotary orientation due to earth's gravity.

25. The apparatus as defined in claim 18 wherein said collar comprises a sprag therein to maintain said substantially fixed rotary orientation.

26. The apparatus as defined in claim 18 wherein said collar comprises fins on an exterior surface thereof to maintain said substantially fixed rotary orientation.

27. The apparatus as defined in claim 18 wherein said collar comprises helical fluid passages therein to maintain said substantially fixed rotary orientation.

* * * * *